US007639017B2

(12) United States Patent
Pekarski

(10) Patent No.: US 7,639,017 B2
(45) Date of Patent: Dec. 29, 2009

(54) METHOD AND ARRANGEMENT FOR MONITORING THE MERCURY CONDENSATION IN AN ARC TUBE

(75) Inventor: Pavel Pekarski, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 136 days.

(21) Appl. No.: 11/722,806

(22) PCT Filed: Dec. 21, 2005

(86) PCT No.: PCT/IB2005/054349

§ 371 (c)(1),
(2), (4) Date: Jun. 26, 2007

(87) PCT Pub. No.: WO2006/072852

PCT Pub. Date: Jul. 13, 2006

(65) Prior Publication Data

US 2008/0068026 A1 Mar. 20, 2008

(30) Foreign Application Priority Data

Jan. 3, 2005 (EP) ..... 05100007

(51) Int. Cl.
*G01R 31/00* (2006.01)

(52) U.S. Cl. ..... 324/405; 324/410; 315/291

(58) Field of Classification Search ..... 324/405, 324/403, 410; 315/291, 196
See application file for complete search history.

(56) References Cited

U.S. PATENT DOCUMENTS

| | | | | |
|---|---|---|---|---|
| 3,086,135 | A * | 4/1963 | Bertele | 313/29 |
| 5,424,613 | A * | 6/1995 | Moriarty, Jr. | 315/209 R |
| 6,166,491 | A | 12/2000 | Tsuchiya et al. | |
| 6,376,998 | B1 * | 4/2002 | Okamoto et al. | 315/291 |
| 2002/0135324 | A1 | 9/2002 | Fujii et al. | |
| 2003/0011320 | A1 | 1/2003 | Okamoto et al. | |
| 2005/0023997 | A1 * | 2/2005 | Chitta | 315/307 |

FOREIGN PATENT DOCUMENTS

| | | | |
|---|---|---|---|
| EP | 1257154 | A2 | 11/2002 |
| JP | 2004031080 | A | 1/2004 |

OTHER PUBLICATIONS

Takashi Toyooka, et al: Illumination Control System for Adaptive Dynamic Range Control, SID International Symposium, May 25, 2004, pp. 174-177, XP007011825.

* cited by examiner

*Primary Examiner*—Vincent Q Nguyen

(57) ABSTRACT

Methods for preventing blackening of a gas filled arc tube of a mercury vapour discharge lamp. Lamp voltage and slope, as well as lamp current and slope are analyzed to determine the state of mercury saturation of the gas in the arc tube. A first control signal is sent to alter the lamp power and a second control signal is sent to alter the level of cooling of the lamp according to the state of mercury saturation. Methods for driving a mercury vapour discharge lamp using a monitoring arrangement and analyzing unit to dynamically control the lamp power and the level of cooling of the lamp are described.

9 Claims, 4 Drawing Sheets

METHOD AND ARRANGEMENT FOR MONITORING THE MERCURY CONDENSATION IN AN ARC TUBE

This invention relates to a method of monitoring the mercury condensation in a gas-filled arc tube of a mercury vapour discharge lamp. Furthermore, the invention relates to a monitoring arrangement for monitoring the mercury condensation in a gas-filled arc tube of a mercury vapour discharge lamp. Moreover, the invention relates to a method for driving a mercury vapour discharge lamp wherein the state of mercury saturation of the gas in an arc tube of the lamp is monitored according to such a method, and to a driving unit for driving a mercury vapour discharge lamp comprising such a monitoring unit, and to a projector system comprising a mercury vapour discharge lamp and such a driving unit.

Mercury vapour discharge lamps comprise an envelope which consists of material capable of withstanding high temperatures, for example, quartz glass. From opposite sides, electrodes made of tungsten protrude into this envelope. The envelope, also called "arc tube" in the following, contains a filling consisting mainly of mercury, and also one or more rare gases. By applying a high voltage across the electrodes, a light arc is generated between the tips of the electrodes, which can then be maintained at a lower voltage. Owing to their optical properties, mercury vapour discharge lamps are preferably used, among others, for projection purposes. For such applications, a light source is required which is as point-shaped as possible. Furthermore, a luminous intensity—as high as possible—accompanied by a spectral composition of the light—as natural as possible—is desired. These properties can be optimally achieved with so called "high pressure gas discharge lamps" or "HID lamps" (High Intensity Discharge Lamps) and, in particular, "UHP-Lamps" (Ultra High Performance Lamps).

Usually, the arc tube of such a high pressure discharge lamp is of very small dimension, e.g. having a volume of some 10 $mm^3$. The high electrode load of such a lamp results in evaporation of tungsten from the electrodes, which is then deposited on the wall of the arc tube, leading to a very undesirable blackening of the arc tube. Such a blackening of the wall must be avoided, otherwise the wall temperature of the arc tube increases during the operational life time of the arc tube, due to increased absorption of thermal radiation, ultimately destroying the arc tube. In an attempt to avoid such wall blackening due to tungsten transport, precise amounts of oxygen and halogen, preferable bromine, have been added to the gas in the arc tube. Such additives to the lamp atmosphere prevent the tungsten, that evaporates from the electrodes, from the deposition on the bulb wall, since, in the cooler regions of the bulb close to the bulb wall, the tungsten atoms react chemically to form volatile oxyhalide molecules which are transported, e.g. through convection, to the hotter regions of the lamp near the electrodes, where the molecules dissociated. In this way, tungsten atoms are returned to the lamp electrodes in a regenerative manner. This transport cycle is usually called the "regenerative cycle".

A problem arises if the lamp is driven with an operational power much below the nominal power of the lamp. Below a certain power level, the mercury condenses, with the result that the halogen, e.g. bromine, is bonded by the liquid mercury. The regenerative cycle is thus no longer effective.

However, the possibility of gradual dimming of projector lamps—where the lamp power is determined by the video content—is desired for future generations of multimedia projectors. It is generally possible to dim the picture for darker scenes by appropriate control of the picture-rendering components of a projector, e.g the display, as has been done to date. However, for a display with particular number of brightness levels (e.g. 8 bits), this technique results in part of the dynamic range being lost, since some of the bits cannot be used. Dimming the projector by means of the picture-rendering components thus leads to a loss in contrast. By dimming the light source, on the other hand, the entire contrast range offered by the picture-rendering components can be put to use, even in dark scenes. For example, the article, "Illumination Control System for Adaptive Dynamic Range Control" by Takashi Toyooka et. al. in SID 04 Digest, 174, 2004 describes that the reduction of the lamp power would be the most preferable measure for dynamic reduction of the light output, but that it is not used because of the limitation imposed by the dimming range of UHP lamps. These limitations for dimming of UHP lamps are usually determined by mercury condensation, as described above. Therefore, in order to increase contrast during dark scenes in video projection applications, it is desirable to reduce the lamp power much below the mercury condensation level.

Insofar as exact information regarding the state of mercury condensation in the arc tube were available, it would be possible, at least for a while, to reduce the lamp power, whereby the lamp power would then be raised before significant blackening could arise as a result of the interrupted regenerative cycle. Owing to the thermal inertia of the lamp, the condensation and evaporation of mercury do not precisely follow the variations in power. The situation becomes even more complex if a forced cooling of the lamp is adapted to the power level. Thus, the duration of lamp operation with condensed mercury depends on the lamp power prehistory, and on the situation of each of the low and high power levels, and on the preceding history of the forced cooling intensity. The state of mercury condensation in the arc tube can therefore not satisfactorily be controlled by simply monitoring the lamp power.

Therefore, an object of the present invention is to provide an easy and cheap method and a corresponding monitoring arrangement for a better monitoring of the mercury condensation.

To this end, the present invention provides a method of monitoring the mercury condensation in a gas filled arc tube of a mercury vapour discharge lamp wherein a lamp voltage and a lamp current are determined and analysed to give an indication of the state of mercury saturation of the gas in the arc tube.

In the normal mode of operation, a mercury vapour discharge lamp displays negative current-voltage characteristics. A reduction of the lamp power, usually effected by reducing the current, causes an increase in operation voltage. However, it could be found that if some mercury has condensed, the voltage response to the variation in power (or current) is determined primarily by the variation in mercury pressure. This results in a different response of a lamp voltage to the reduction in current. Contrary to the case of an unsaturated lamp, the voltage of a saturated lamp drops due to mercury condensation and the resulting reduction in mercury pressure. Similar differences in voltage response behaviour are observed in the case of an increase in current. This behaviour can be explained as follows: if the current is reduced during the unsaturated regime, i.e. in normal mode of operation, the plasma between the electrodes cools to a lower temperature and the degree of ionization drops. As a result, the resistance of the lamp increases, as does the operation voltage. In a state of saturation, on the other hand, increasing the current results in an increased heat output of the lamp. This leads at first to mercury evaporation from the molten mass. The increase in evaporated mercury atoms in the gas also results in an increase of the resistance of the lamp. This effect plays a dominant role and leads to the increase in voltage if the current is increased for a saturated lamp.

This observation regarding the behaviour of the voltage as a function of the level of current is put to good effect in the method according to the invention in order to determine, in an easy and uncomplicated manner, an indication of the state of mercury saturation in the bulb by simultaneously measuring the voltage and the current as well as the relationship of these measurements to one another.

An appropriate monitoring arrangement for monitoring the mercury condensation in a gas-filled arc tube of a mercury vapour discharge lamp should comprise the following components: a voltage determination unit for determining a lamp voltage, a current determination unit for determining a lamp current, an analysing unit for analysing the determined lamp voltage and determined lamp current and for giving an indication regarding the state of mercury saturation of the gas in the arc tube according to the result of the analysis.

Such a monitoring arrangement can essentially be realised in any lamp control unit for controlling a mercury vapour discharge lamp. Equally, such a lamp control unit can be incorporated in almost any projector system or other image rendering system comprising a mercury vapour discharge lamp. At least the analysing unit can be realised as software in a programmable microprocessor of an image rendering control unit or lamp control unit. For example, since most projector systems already feature suitable voltage and current measurement units for regulating the voltage and current, and since such devices usually also feature programmable microprocessors, existing control units and/or projector systems can be adapted simply by installing an appropriate software update.

If the state of mercury saturation of the gas in an arc tube of the lamp is monitored according to the invention, this measurement might be used in a method for driving a mercury vapour discharge lamp wherein the lamp power and/or cooling-off the lamp are controlled according to the state of mercury saturation. For example, a representative value which for the state of mercury saturation may be submitted to a power controller and/or cooling controller for use in a controlling cycle. In particular, with the aid of this monitoring of the state of mercury condensation, it is possible to control the lamp power in such a way that a temporary dimming of the lamp is effected below the power level at which mercury begins to condense. With the aid of the invention, it is possible to determine the point at which the lamp power must be increased in order to avoid a significant blackening of the walls of the arc tube.

The dependent claims and the subsequent description disclose particularly advantageous embodiments and features of the invention.

In a particularly elementary embodiment of the invention, a property only, for example the sign of the slope of a current/voltage characteristic of the lamp, is determined to give a qualitative indication regarding the state of mercury condensation. In other words, it is simply monitored whether the voltage increases or decreases with increase in current, or whether a drop in current results in an increase or decrease in voltage. This information is then used as an indication whether the lamp is operating in a saturated regime or in an unsaturated regime.

The analysis of the sign of the slope of a current voltage can be realised by the simple analysis of the slopes of the measured lamp voltage and the lamp current, by, for example, measuring the lamp voltage over a certain short period of time and the lamp current over a short period of time, and determining the slopes of the lamp current and voltage. The relationship of the slope of the measured lamp current to the slope of the measured lamp voltage yields the slope of the current/voltage characteristic and therefore also the required sign of the slope.

In a further embodiment of the invention, the ratio of the slope of the lamp voltage to the slope of the lamp current is used to give a quantitative indication regarding the state of mercury saturation in the lamp.

Generally the invention might be used for all types of mercury vapour discharge lamps. Preferably it is used for HID lamps and particularly UHP lamps. The invention can also be applied to other lamps which are not intended for use in projection systems, for example, lamps for automotive lighting systems.

Other objects and features of the present invention will become apparent from the following detailed descriptions considered in conjunction with the accompanying drawings. It is to be understood, however, that the drawings are designed solely for the purposes of illustration and not as a definition of the limits of the invention. In the drawings, wherein like reference characters denote the same elements throughout:

The dimensions of the objects in the figures have been chosen for the sake of clarity and do not necessarily reflect the actual relative dimensions.

Figure 1:
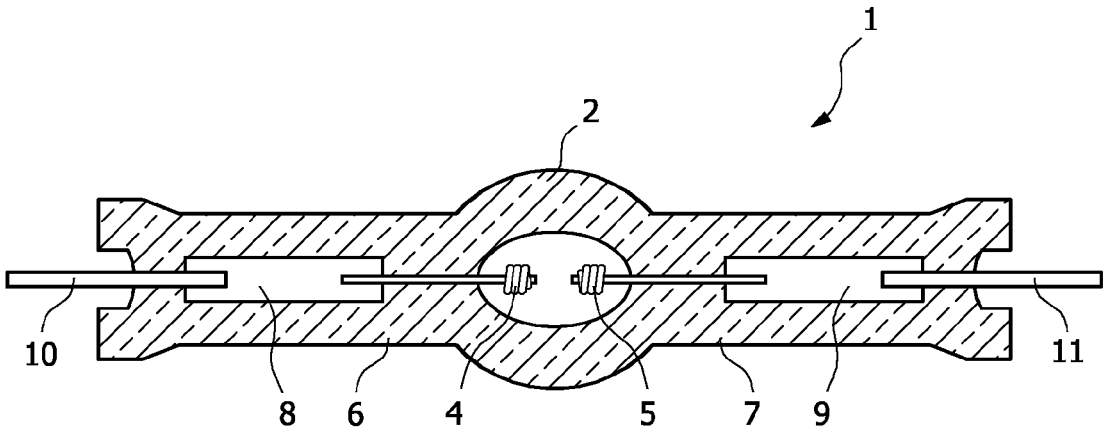
FIG. 1 shows a longitudinal through a high-pressure mercury vapour discharge lamp.

The high-pressure mercury vapour discharge lamp 1 shown in FIG. 1 has an elliptical arc tube 2 of quartz glass. The ends of the arc tube 2 are adjoined by cylindrical quartz parts 6, 7, into which molybdenum foils 8, 9 are sealed in a vacuum-tight manner. The inner ends of the molybdenum foils 8, 9 are connected to electrodes 4, 5 which protrude into the arc tube 2. These electrodes 4, 5 are made from tungsten. On the ends which protrude into the bulb, the electrodes 4, 5 carry wrappings or coils of tungsten. The outer ends of the molybdenum foils 8, 9 are connected to current supply wires 10, 11 which lead to the exterior of the lamp.

The arc tube 2 is filled with rare gas and mercury. Furthermore, a small amount of bromine is also present in the arc tube 2. The principle of operation of such a lamp 1, and particularly the regeneration cycle which, with the aid of bromine addition to the gas, ensures that tungsten does not settle on the inner walls of the arc tube, has already been explained in detail above. That mercury condensing into liquid form also presents a problem, owing to the fact that bromine atoms are bound by liquid mercury, with the result that the regenerative cycle is then interrupted, has also already been explained.

Figure 2:
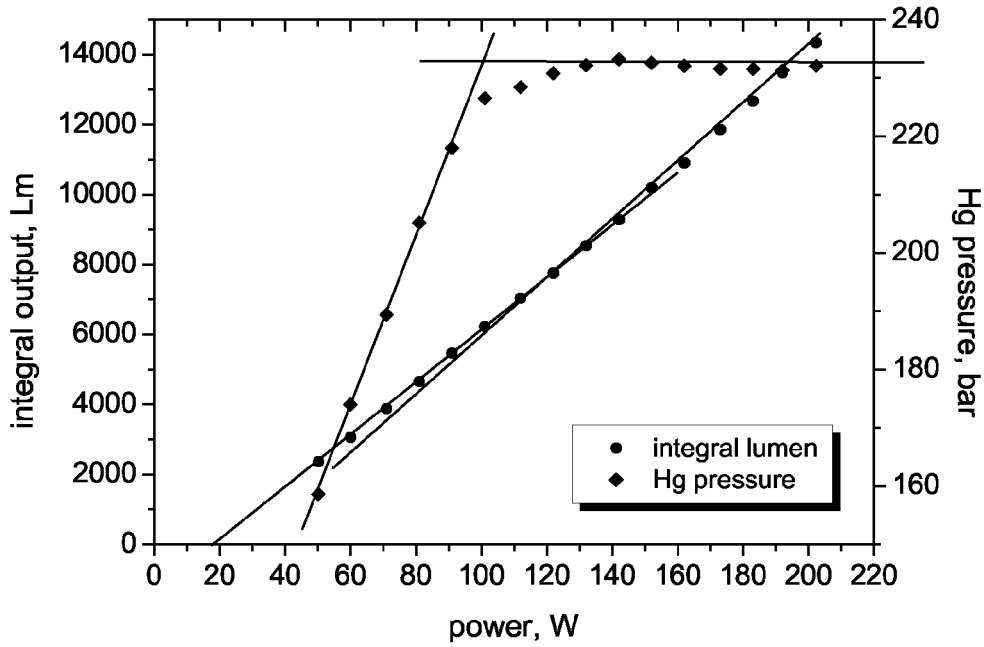
FIG. 2 shows a graph of the integral light output and mercury pressure vs. operational power for 200 Watt UHP burner.

FIG. 2 shows the relationship between mercury pressure and operational power for a 200 W UHP lamp. Mercury pressure is indicated by the lozenge-shaped markers. It can be seen clearly that, below an operational power of 120 W, mercury starts to condense. FIG. 2 also shows the relationship between integral light output and the operational power (round markers). This illustrates that, for a 200 W UHP lamp, reduction of the light output is limited to 30% when one wishes to ensure that the UHP lamp does not operate in the saturated regime in which mercury is present in liquid form. The same problem arises with the usual 120 W UHP lamps. These cannot be dimmed below 100 W if condensation of mercury is to be avoided. On the other hand, since the state of mercury condensation only follows the reduction of the lamp power with a delay, it is possible, in principle, to allow the lamp to operate for a certain length of time in a lower power range without necessarily resulting in damage to the lamp. To this end, the state of mercury is monitored according to the present invention.

Figure 3:
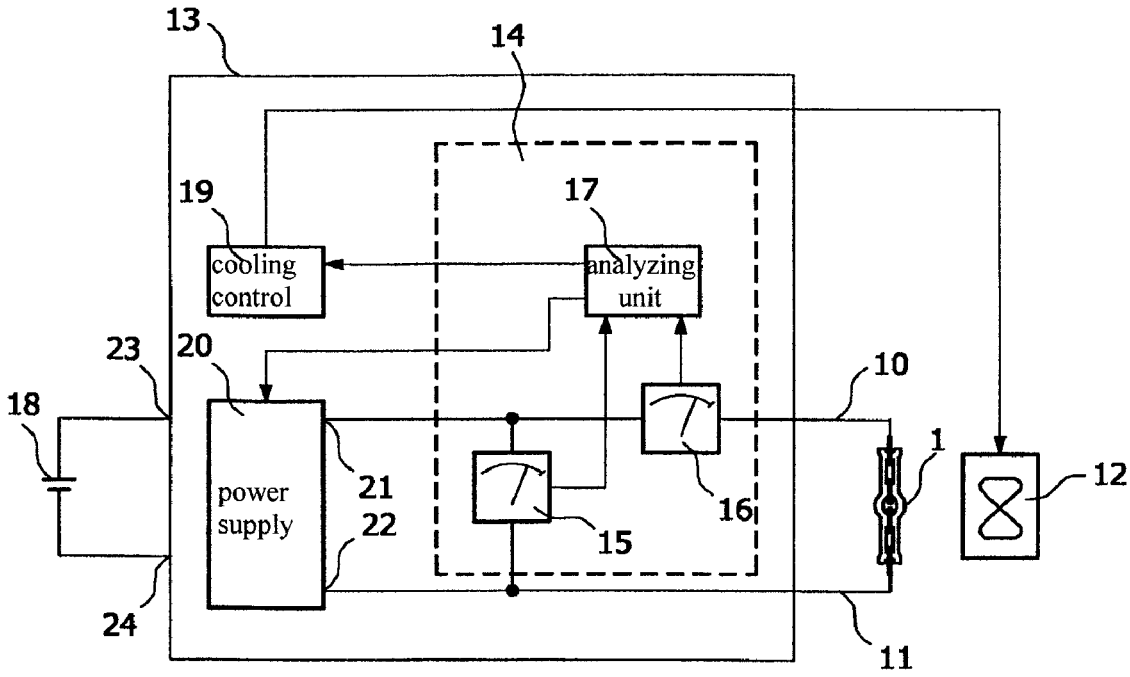
FIG. 3 shows a schematic block diagram of a lamp control unit comprising a monitoring unit according to the invention.

A lamp control unit 13 with a monitoring arrangement 14, which can be used for monitoring state of mercury saturation in the arc tube, will be described in the following with the aid of FIG. 3. This figure illustrates, schematically, the components relevant to the invention. This lamp control unit 13 can also comprise any other components usually required for the operation of a mercury vapour discharge lamp. Such a lamp control unit is often also called a "lamp driver".

The heart of the lamp control unit 13 is a power supply unit 20 with two connectors 21, 22, which are connected to the lamp 1 by means of the leads 10, 11. In the present case, the lamp 1 is a cooled UHP lamp 1, which is equipped with a cooling unit 12. The cooling unit 12 is controlled by a cooling control unit 19, which is also part of the lamp control unit 13. The lamp control unit 13 is connected to a power supply 18 by means of two connectors 23, 24.

According to the invention, the lamp control unit 13 comprises a monitoring arrangement 14. This in turn comprises a voltage measuring unit 15, which is connected in parallel to the lamp 1 to the poles 21, 22 of the power supply unit 20, and which measures the voltage between the leads 10, 11 of the lamp 1. Furthermore, a current measuring unit 16, placed in the leader 10 to the lamp 1, measure the current flowing through the lamp 1. This current measuring unit 16 can, for example, measure the current using induction.

The monitoring arrangement 14 also comprises an analysing unit 17, to which the voltage measuring unit 15 and the current measuring unit 16 are connected, and to which they report their measurements. In the analysing unit 17, the measurement values of the voltage measuring unit 15 and the current measuring unit 16 are recorded, and the resulting current and voltage curves are analysed.

Figure 4:
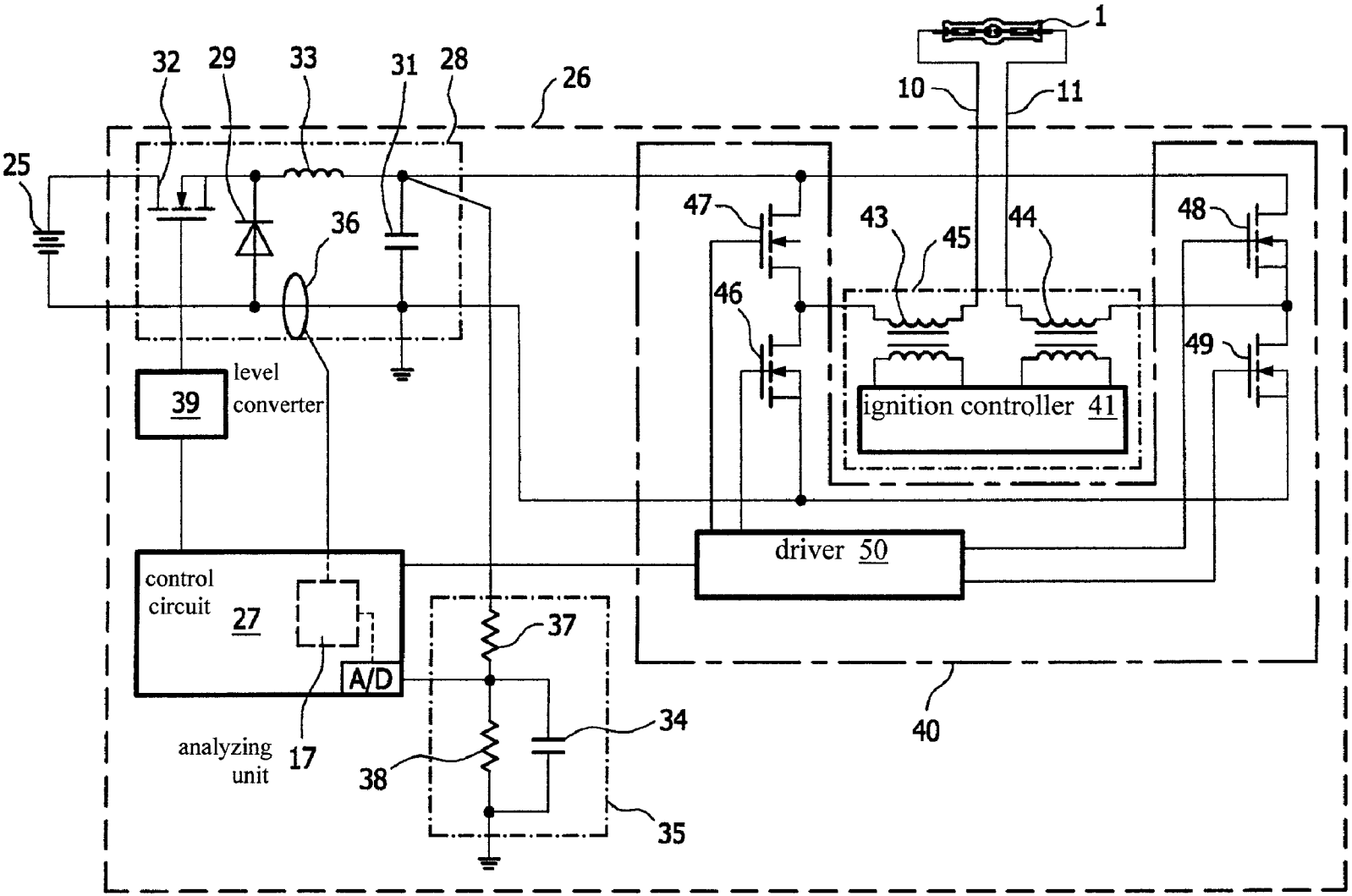
FIG. 4 shows a detailed block diagram of a further lamp control unit comprising a monitoring unit according to the invention.

FIG. 4 shows a more detailed circuit for a possible realisation of a lamp driver 26 with a monitoring arrangement according to the present invention. The driver circuit 26 comprises a direct current converter 28, a commutation stage 40, an ignition arrangement 45, a control circuit 27, a voltage measuring unit 35, and a current measuring unit 36.

The control circuit 27 controls the converter 28, the commutation stage 40, and the ignition arrangement 45, and monitors the voltage behaviour of the lamp driver 26 at the gas discharge lamp 1. The commutation stage 40 comprises a driver 50 which controls four switches 46, 47, 48, 49. The ignition arrangement 45 comprises an ignition controller 41 and an ignition transformer which generates, with the aid of two chokes 43, 44, a symmetrical high voltage so that the lamp 1 can ignite.

The converter 28 is fed by an external direct current supply 25 of, for example, 380V. The direct current converter 28 comprises a switch 32, a diode 29, an inductance 33 and a capacitor 31. The control circuit 27 controls the switch 32 via a level converter 39, and thus also the current in the lamp 1.

The voltage measuring unit 35 is connected in parallel to the capacitor 31, and is realised in the form of a voltage divider with two resistors 37, 38. A capacitor 34 is connected in parallel to the resistor 38.

For voltage measurement, a reduced voltage is diverted at the capacitor 31 via the voltage divider 37, 38, and measured in the control circuit 27 by means of an analog/digital converter. The capacitor 34 serves to reduce high-frequency distortion in the measurement signal. The current in the lamp 1 is monitored in the control circuit 27 by means of the current measuring unit 36, which also operates on the principle of induction. Since the control circuit 27 controls the current in the lamp 1 by means of the level converter 39 and the switch 32, the momentary current level can also be taken over in the control circuit 27. In this case, the current measuring unit required according to the invention is directly integrated in the control circuit, and the external current measuring unit 36 shown in FIG. 4 can, for example, be used for checking purposes, or, for some types of lamps, be dispensed with entirely.

The control circuit 27 comprises a programmable microprocessor. The analysing unit 17 is implemented here in the form of software running on the microprocessor of the control circuit. The analysing unit 17 records and analyses the measurement values reported by the voltage measuring unit 35 and the current measuring unit 36.

Figure 5:
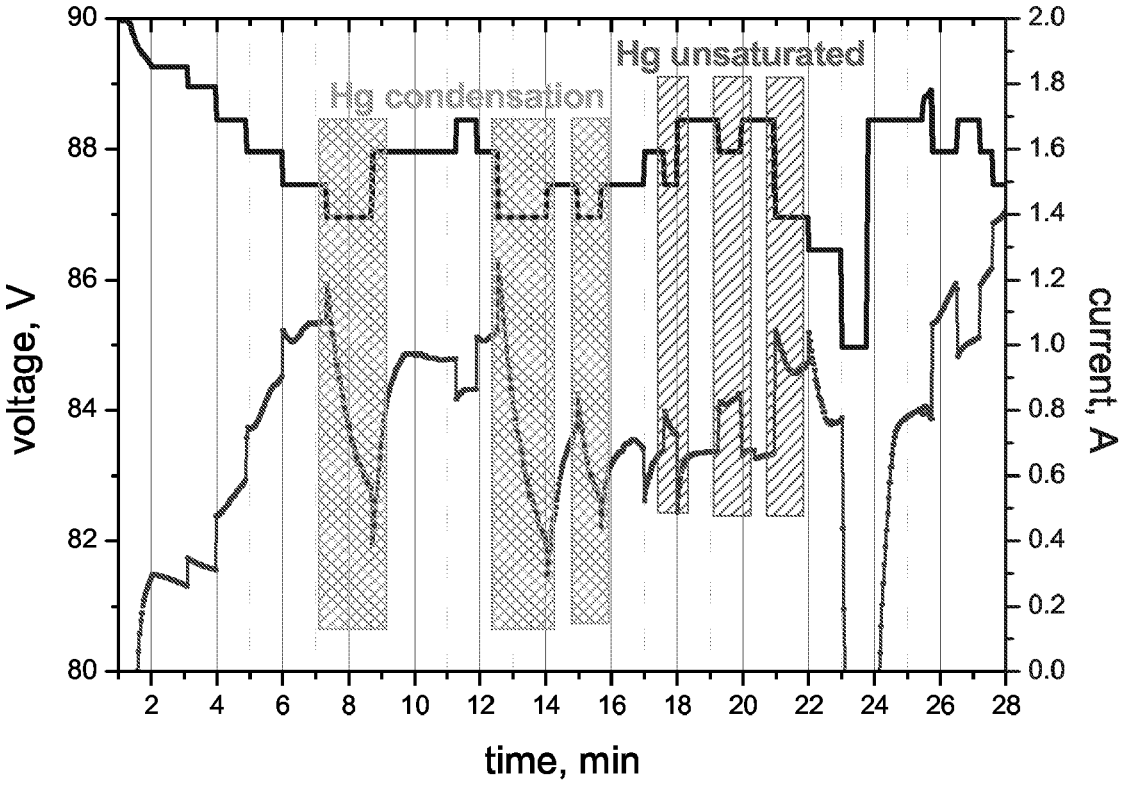
FIG. 5 shows the voltage changes of a 120 Watt UHP lamp during variation of the lamp power.

FIG. 5 shows an example of current (upper) and voltage (lower) curves recorded in parallel over the same period of time. In certain regions, cross-hatched differently to distinguish them from each other, the behaviour of voltage as a function of the change in lamp power—and therefore a change in lamp current—is analysed. Thereby, it is determined whether the voltage drops when the current is reduced, or whether the voltage increases. By making this observation alone, it is possible to determine the state of mercury saturation in the arc tube.

As is evident from FIG. 5, the behaviour of the voltage as a function of a change in current, in those regions in which mercury condensation is occurring, differs clearly from its behaviour in the regions in which the lamp is operating in an unsaturated regime. Whilst a reduction in current results in a corresponding drop in voltage during the mercury condensation regime, and increasing the current results in a corresponding rise in voltage, a reduction in current during the mercury unsaturated regime leads to an increase in voltage, and vice versa. Therefore, the lamp exhibits a positive current-voltage characteristic in the mercury condensation regime, whereas it exhibits the—normal—negative current-voltage characteristic during the mercury unsaturated regime. By means of an exact evaluation of the relationship of the voltage reduction as a function of a reduction in current, conclusions can be drawn about the quantitative mercury condensation.

With the aid of the monitoring arrangement 14, it is therefore possible to directly determine the state of mercury saturation in the lamp 1. Accordingly, suitable control signals can be sent from the monitoring arrangement 14 to the power supply unit 20 and the cooling control unit 19 of the lamp control unit 13, so that, for example, by raising the operational lamp power or by reducing the level of cooling, measures can be taken in time to prevent blackening from taking place and destroying the lamp. This allows dimming of the lamp considerably below the nominal power during operation, at least for certain periods of time. In a test run over several hours, it was possible, by suitable controlling of the cooling unit 12 and the power supply unit 20, to dim the lamp to a level at which a UHP lamp is driven in saturated regime. It was even possible to dim the lamp down to 40% of nominal power. This demonstrates that, for example, with the aid of the invention, the adaptive dynamic range control described earlier can be realised by dimming the lamp, and that optimum performance can thereby be attained.

Although the present invention has been disclosed in the form of preferred embodiments and variations thereon, it will be understood that numerous additional modifications and variations could be made thereto without departing from the scope of the invention. For the sake of clarity, it is also to be understood that the use of "a" or "an" throughout this application does not exclude a plurality, and "comprising" does not exclude other steps or elements. Also, a "unit" may comprise a number of blocks or devices, unless explicitly described as a single entity.

The invention claimed is:

1. A monitoring arrangement for monitoring mercury condensation in a gas-filled arc tube of a mercury vapour discharge lamp comprising:

a voltage determination unit for determining a lamp voltage;

a current determination unit for determining a lamp current;

an analyzing unit for analyzing the determined lamp voltage and determined lamp current, wherein the analyzing unit provides the ratio of the slope of the lamp voltage to the slope of the lamp current for giving an indication about the state of mercury saturation of the gas in the arc tube, and wherein the analyzing unit is configured to send a first control signal to alter the lamp power and a second control signal to alter the level of cooling of the lamp according to the state of mercury saturation.

2. A driving unit for driving a mercury vapour discharge lamp, comprising a monitoring arrangement according to claim 1.

3. An image rendering system comprising a mercury vapour discharge lamp and a driving unit according to claim 2.

4. A method for driving a mercury vapour discharge lamp, comprising:

determining a lamp voltage and a slope of the lamp voltage;

determining a lamp current and a slope of the lamp current;

analyzing the lamp voltage and lamp current to determine the state of mercury saturation of the gas in the arc tube; and controlling dynamically the lamp power and the level of cooling of the lamp at the same time to alter the state of mercury saturation by sending a first control signal to alter the lamp power and a second control signal to alter the level of cooling of the lamp according to the state of mercury saturation.

5. The method of claim 4, wherein the state of mercury saturation is determined from the ratio of the slope of the lamp voltage to the slope of the lamp current.

6. The method of claim 4, wherein the mercury vapour discharge lamp is a high intensity discharge lamp or an ultra high performance lamp.

7. A method for preventing blackening of a gas filled arc tube of a mercury vapour discharge lamp, comprising:

determining a lamp voltage and a slope of the lamp voltage;

determining a lamp current and a slope of the lamp current;

analyzing the lamp voltage and lamp current to determine the state of mercury saturation of the gas in the arc tube; and sending a first control signal to alter the lamp power and a second control signal to alter the level of cooling of the lamp according to the state of mercury saturation.

8. The method of claim 7, wherein the state of mercury saturation is determined from the ratio of the slope of the lamp voltage to the slope of the lamp current.

9. The method of claim 7, wherein the mercury vapour discharge lamp is a high intensity discharge lamp or an ultra high performance lamp.

* * * * *